US007419006B2

(12) United States Patent
Armstrong

(10) Patent No.: US 7,419,006 B2
(45) Date of Patent: Sep. 2, 2008

(54) APPARATUS FOR PROTECTING WELLHEADS AND METHOD OF INSTALLING THE SAME

(75) Inventor: James E. Armstrong, Houston, TX (US)

(73) Assignee: WZI, Inc., Bakersfield, CA (US)

( * ) Notice: Subject to any disclaimer, the term of this patent is extended or adjusted under 35 U.S.C. 154(b) by 371 days.

(21) Appl. No.: 11/090,416

(22) Filed: Mar. 24, 2005

(65) Prior Publication Data

US 2006/0231273 A1 Oct. 19, 2006

(51) Int. Cl.
*E21B 29/12* (2006.01)
*E21B 19/00* (2006.01)

(52) U.S. Cl. ..... 166/351; 166/360; 166/338; 175/85; 405/209

(58) Field of Classification Search ..... 166/85.1, 166/351, 379, 360, 368, 338; 405/209, 206; 114/258; 175/85
See application file for complete search history.

(56) References Cited

U.S. PATENT DOCUMENTS

| | | | | | |
|---|---|---|---|---|---|
| 1,830,061 | A | | 11/1931 | Howe | |
| 3,802,137 | A | * | 4/1974 | Armstrong | 52/118 |
| 3,941,189 | A | | 3/1976 | Peevey | |
| 3,974,657 | A | * | 8/1976 | Sumner | 405/209 |
| 3,999,396 | A | * | 12/1976 | Evans | 405/196 |
| 4,055,264 | A | * | 10/1977 | Abbott | 414/803 |
| 4,065,934 | A | * | 1/1978 | Dysarz | 405/196 |
| 4,103,503 | A | * | 8/1978 | Smith | 405/196 |
| 4,144,940 | A | * | 3/1979 | Ortemond | 175/5 |
| 4,156,577 | A | * | 5/1979 | McMakin | 405/196 |
| 4,160,060 | A | | 7/1979 | Bynum, Jr. | |
| 4,208,158 | A | * | 6/1980 | Davies et al. | 414/22.68 |
| 4,224,005 | A | * | 9/1980 | Dysarz | 405/196 |
| 4,399,040 | A | * | 8/1983 | Ayers et al. | 210/749 |
| 4,534,677 | A | * | 8/1985 | Albaugh | 405/203 |
| 4,544,135 | A | * | 10/1985 | Albaugh | 254/108 |
| 4,602,894 | A | * | 7/1986 | Lorenz et al. | 405/203 |
| 4,829,924 | A | * | 5/1989 | Dysarz | 114/32 |
| 4,973,198 | A | * | 11/1990 | Cox | 405/201 |
| 5,038,871 | A | * | 8/1991 | Dinsdale | 175/52 |
| 5,290,128 | A | * | 3/1994 | Yeargain et al. | 405/209 |
| 5,292,207 | A | * | 3/1994 | Scott | 405/207 |
| 5,388,930 | A | * | 2/1995 | McNease | 405/209 |
| 5,407,302 | A | * | 4/1995 | Springett et al. | 405/196 |
| 5,419,657 | A | * | 5/1995 | Davis | 405/209 |
| 6,158,516 | A | * | 12/2000 | Smith et al. | 166/385 |
| 6,299,383 | B1 | * | 10/2001 | Finn et al. | 405/209 |
| 6,554,075 | B2 | * | 4/2003 | Fikes et al. | 166/379 |
| 6,675,899 | B2 | * | 1/2004 | Coats | 166/379 |

(Continued)

FOREIGN PATENT DOCUMENTS

GB 2203782 * 10/1983

*Primary Examiner*—Thomas A Beach
(74) *Attorney, Agent, or Firm*—Klein, DeNatale, Goldner; James M. Duncan

(57) ABSTRACT

An apparatus and method for protecting wellheads of a fixed-leg drilling and production platform which provide an alternative from the shutting in of producing wells as currently required. The apparatus provides a structural barrier for the production process systems of the platform, shielding such systems from heavy objects which may be dropped in the course of rig mobilization and skidding procedures. A method of installing an embodiment of the apparatus allows the barrier to be installed without shutting in the production wells.

17 Claims, 14 Drawing Sheets

U.S. PATENT DOCUMENTS 6,719,062 B2 * 4/2004 Fikes et al. ..... 166/379
6,901,998 B1 * 6/2005 Roodenburg et al. ..... 166/85.1
7,040,411 B2 * 5/2006 Kainer et al. ..... 166/379
2005/0241857 A1 * 11/2005 Beato et al. ..... 175/57

* cited by examiner

APPARATUS FOR PROTECTING WELLHEADS AND METHOD OF INSTALLING THE SAME

BACKGROUND OF THE INVENTION

The present invention generally relates to fixed leg platforms used in relatively shallow water for producing mineral resources, specifically oil and gas. The present invention more specifically relates to various embodiments of an apparatus and a method of installing an apparatus which protects wellheads from being struck from objects or equipment which may fall and impact the wellhead and production processing equipment.

Offshore hydrocarbon production in federal waters is regulated by the Minerals Management Service (the "MMS"). The MMS currently requires that wells be shut-in during various operations, including operations to install a drilling or work-over rig on the platform. Specifically, the applicable regulations require that all producing wells in the affected wallaby be shut in below the surface and at the wellhead when a drilling rig is moved between wells on the platform. The regulation also requires that wells be shut-in during rigging up and rigging down activities which occur within 500 feet of the affected platform or when a drilling unit is moved between wells on a platform or when a mobile offshore drilling unit moves within 500 feet of a platform.

This regulation recognizes that many heavy components are lifted over the wallaby and over the wellheads and production piping therein during the mobilization and moving of a drilling rig, presenting the risk that a heavy component may be dropped onto the production piping of a wellhead resulting in damage to the facilities and the possible release of hydrocarbons. The regulation further provides that once enough of the drilling rig, such as the superstructure, is over the well of interest, the wells may be returned to production. However, for a variety of reasons, the moving of a drilling rig may be delayed, resulting in a prolonged period that one or more producing wells are shut-in. For example, in rough seas the work boat transporting rig components may be delayed while waiting for smoother seas to deliver the components to the platform.

Shutting in producing wells is problematic for at least two reasons. First, production is lost or delayed when wells are shut-in. Bringing the wells back online can be time-consuming and may require substantial supervision to safely return the wells to production. Second, some wells are damaged from being shut-in, and do not always return to their previous flow rates after the wells are returned to production. For example, fine particles may be repositioned within the reservoir rock as a result of ebbing and surging flow associated with stopping and resuming of the production in a well. Loss of production is not only detrimental to the owner of the wells, but it also adversely impacts the royalties received by the federal government.

The MMS regulations grant the MMS District Supervisor some discretion in the shutting in of producing wells. The regulations provide that the MMS District Supervisor may approve departures from the shut-in requirement by making application to the District Supervisor. Among other information, the District Supervisor may consider platform structural data and point load calculations showing that the production process systems can withstand the impact of a dropped object. The District Supervisor may also consider a lift sequence plan which describes the order of the lifts, and the lift positioning on the platform deck relative to the wallaby areas and production processing equipment.

SUMMARY OF THE INVENTION

The embodiments of the apparatus disclosed herein and the disclosed method provide an alternative for departing from the MMS shut-in requirements by providing an effective structural barrier for the production process systems. Each embodiment is used on a fixed-leg offshore drilling and production platform, where the platform is of the type having one or more wellheads disposed on a production deck. Because there is limited space on a production platform, each wellhead is located in close proximity to the next adjacent wellhead, where the centerlines of the wellheads are usually only a few feet apart from one another. Hydrocarbon fluids, such as oil and gas, are produced through the wellheads and produced into the platform's production process system.

The area immediately adjacent to the wellheads, both laterally and spatially, is known as the wallaby. The wallaby is usually separated from adjacent platform systems by one or more firewalls, which usually extend upwardly from the production deck to the drilling deck. The wellhead production trees and connected piping are contained within the wallaby area.

The platform further comprises a pair of skid beams, herein designated the first skid beam and the second skid beam, which are generally horizontally disposed in parallel relation to one another and disposed above the production deck. The top surface of the skid beams usually extends above the drilling deck for receiving the components of a modular drilling rig or production rig, which are typically erected on a modular substructure attached to the skid beams. A modular drilling rig may be repositioned along the skid beams and along the drilling rig substructure to allow the drilling of additional wells from different locations within the wallaby without completely dismantling the drilling rig.

The level of the platform at which the drilling rig substructure is placed is usually referred to as the drilling deck. The platform usually has a fixed crane which is used for lifting equipment off of supply boats and for repositioning equipment to various locations on the platform. A platform will frequently have a designated area for setting down equipment lifted off of supply boats by the crane. Often this designated area is a portion of the drill deck which is referred to herein as the "wing deck".

The skid beams may also be used for supporting well maintenance equipment in addition to well drilling equipment. As those skilled in the art are aware, hydrocarbon wells frequently require a rig for well maintenance, such as well clean out, casing repair, replacement of downhole production equipment, additional perforating, well stimulation, or other maintenance operations generally referred to as "work overs." The substructure of a maintenance rig is typically erected on the skid beams in similar fashion as a modular drilling rig.

An embodiment of an apparatus for protecting the wellhead and other production facilities during mobilization and operation of either well drilling or well maintenance equipment comprises a first support beam which overlays at least a portion of the first skid beam and a second support beam overlaying at least a portion of the second skid beam. The first support beam and the second support beam each have a top surface adapted for receiving either well drilling or well maintenance equipment, such as a drilling rig or a work-over rig. A first cross-member and a second cross-member span between the first support beam and the second support beam, where the first cross-member and second cross-member are generally in parallel relation to one another. Means for securing the ends of the first cross-member and the second cross-member to the first support beam and the second support beam are provided. At least one well cover panel spans between the first cross-member and the second cross-member. The well cover panel comprises a first side end and an opposing second side end. The well cover panel slid ably overlays a portion of the first cross-member and to the second cross-member. The components of the disclosed apparatus have sufficient structural integrity to effectively shield wellheads and the associated production piping from items which may be inadvertently dropped during the relocation or operation of a drilling or work over rig.

The apparatus itself may be assembled in such a manner that none of the components of the apparatus need be lifted directly over the wellheads or production piping, so that shutting in of the wells is not required for installation and placement of the apparatus. Therefore, a method of installing one or more embodiments of the apparatus is disclosed.

An embodiment of the method comprises the steps of disposing a first support beam to overlay at least a portion of the first skid beam and disposing a second support beam in parallel relation to the first support beam, wherein the second support beam overlays at least a portion of the second skid beam. A first cross-member is placed so that it spans between the first support beam and the second support beam. Likewise, a second cross-member is placed so that it also spans between the first support beam and the second support beam. The first cross-member and the second cross-member are installed such that the first cross-member and second cross-member are adapted to slide in parallel relation to one another. A well cover panel is disposed between the first cross-member and the second cross-member, where the well cover panel is adapted to slide across a portion of the length of the first cross-member and a portion of the length of the second cross-member. The first support beam, the second support beam, the first cross-member, the second cross-member, and the well cover panel collectively comprise the wellhead cover assembly. The wellhead cover assembly is slid from a first position overlaying the wing deck to a second position overlaying the well bay. The well cover panel is slid to a position directly overlying the wellhead. Once the well cover panel is in place, the well drilling equipment or the well maintenance equipment may be installed on the platform.

DETAILED DESCRIPTION OF THE EMBODIMENTS

Figure 1:
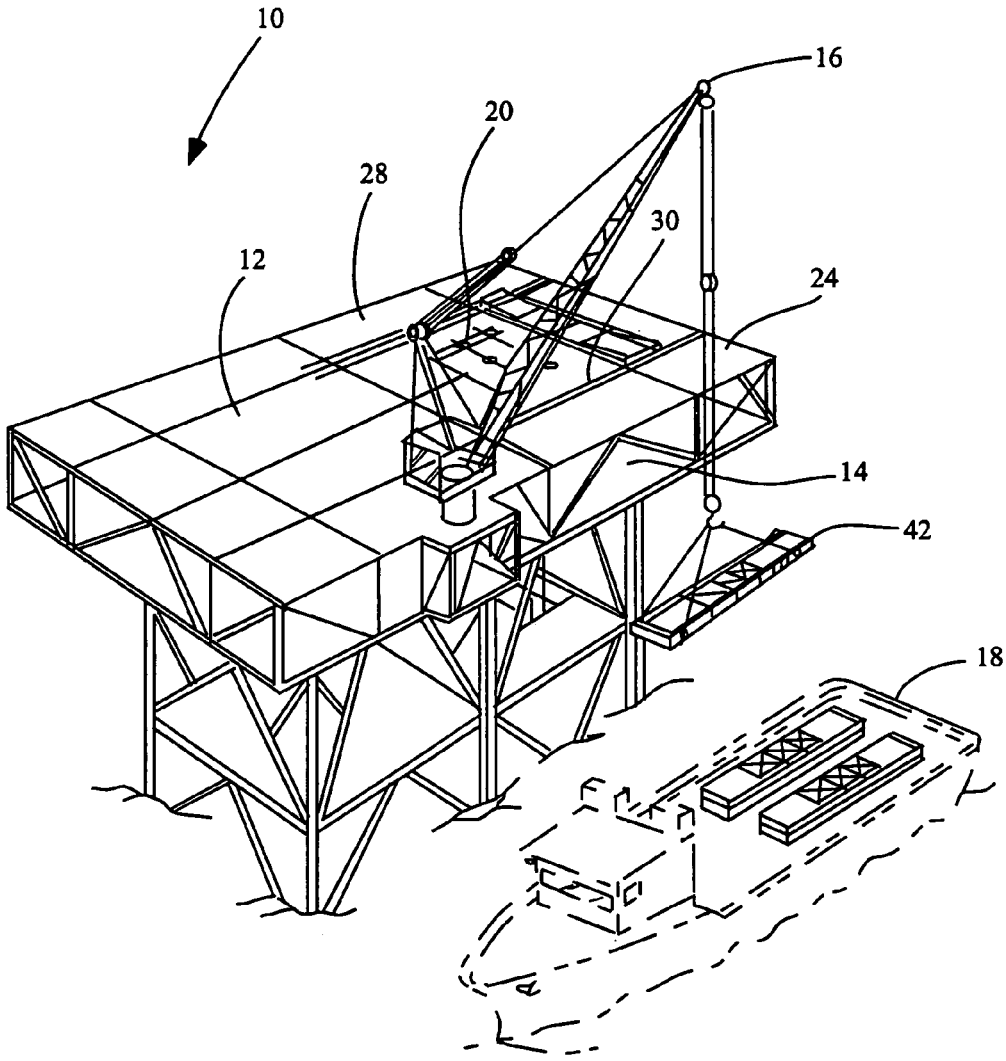
FIG. 1 generally shows a fixed leg platform and how various items, including components of the disclosed apparatus, may be lifted by crane and deposited onto the platform deck.

Referring now specifically to the drawings, FIG. 1 generally shows a production platform 10. The platform 10 may comprise a drill deck 12 and production deck 14. The platform may further comprise crane 16, which may be used, among other things, for offloading materials and supplies from delivery vessels, such as workboat 18 shown in FIG. 1. For fixed leg production platforms such as that depicted in FIG. 1, hydrocarbon wells are typically drilled by a drilling rig which is erected on the drill deck 12. After drilling is initiated for each well, the wellhead for each well is typically located at the production deck 14. After drilling has been completed for a well, various piping fixtures are attached to its wellhead for receiving oil, gas and other fluids which may be produced from the underlying hydrocarbon reservoir and produced through the wellhead into the platform's production processing system. Usually, separation facilities on the platform separate gas from the liquids and separate water from the oil. Gas and oil may then be shipped off of the platform via pipeline or tanker.

Figure 12:
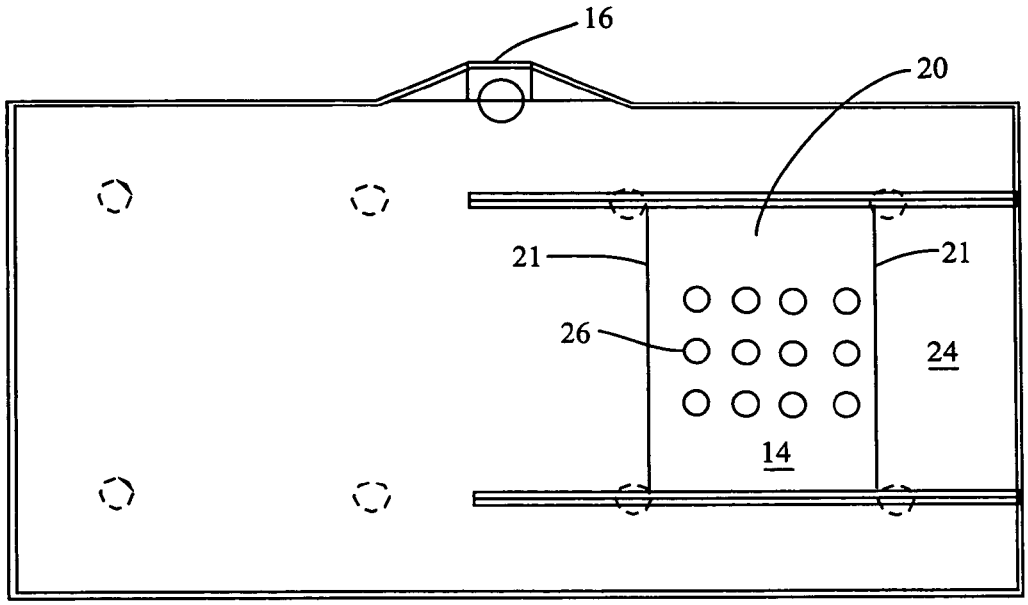
FIG. 12 shows a schematic of a platform deck, showing the wing deck area and the well bay area.
Figure 13:
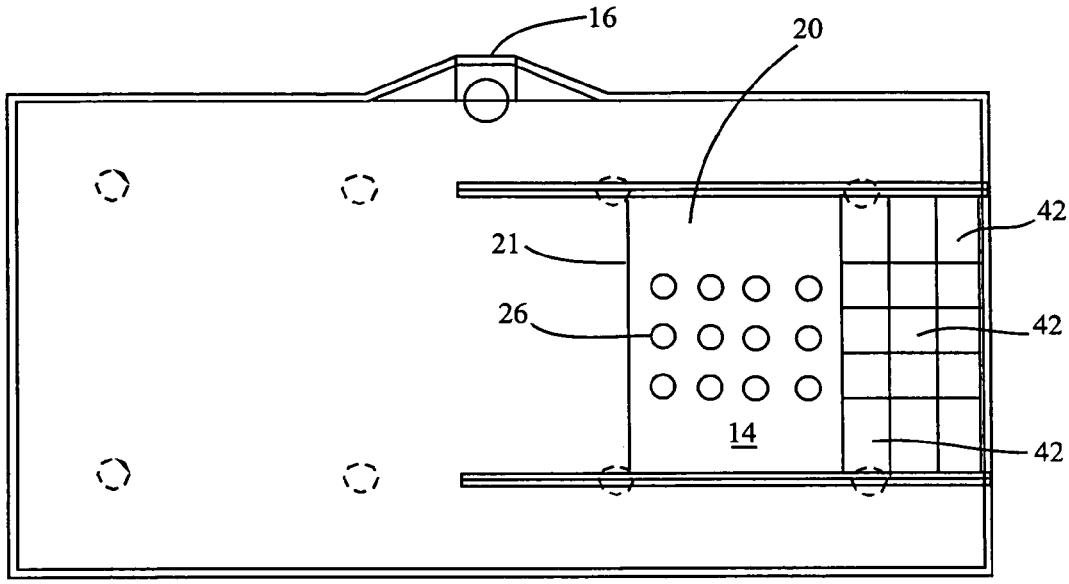
FIG. 13 shows a schematic of an embodiment of the disclosed apparatus being assembled at the wing deck area.

Because combustible fluids are usually produced through the wellheads, the wellheads and attached piping are usually separated from other platform facilities by one or more firewalls 21. The space in which the wellheads and the attached piping are located is generally referred to as the wallaby 20. The wallaby 20 commonly extends from the level of the drill deck 12 of the platform down to the level of the production deck 14, and wellheads 26 in the wallaby are accessed from above by either a drilling rig, work over rig or a wire line unit. Wellheads 26 and firewalls 21 are schematically shown in FIGS. 12 and 13.

Figure 2:
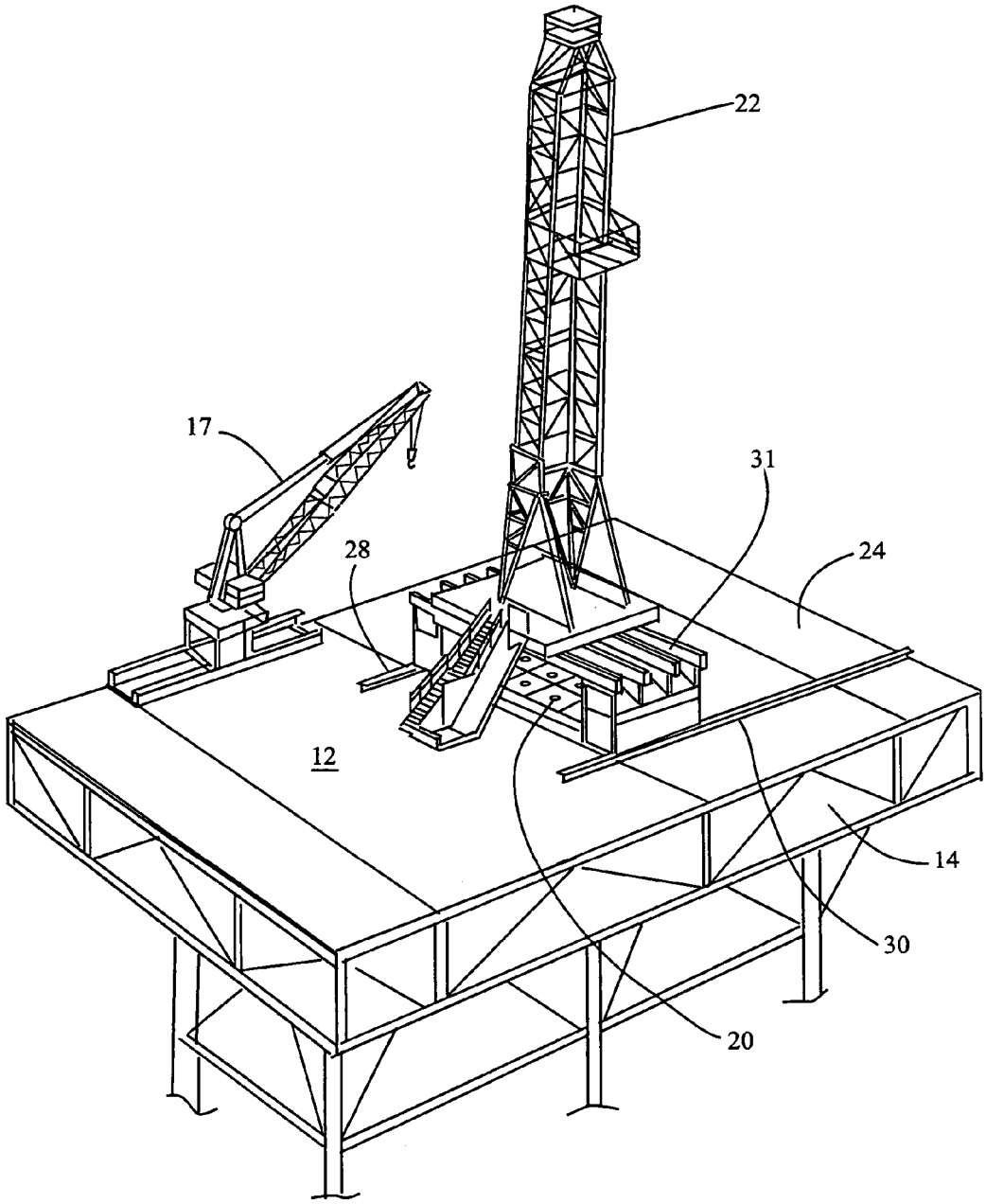
FIG. 2 schematically shows the disclosed apparatus and an erected modular drilling rig or work-over rig.

When a modular drilling rig 22 is installed on a production platform 10, the rig is designed to be positioned or "skid" over to the desired "slot" of the wallaby 20 without dismantling of the rig. As shown in FIG. 2, a rig 22 can usually be skidded along the length of the platform along the skid beams 28, 30. In addition, a rig 22 can usually skid along the width of the platform along substructure beams 31. The capability of the rig 22 to be moved both length-wise and width-wise above the well bay 20 allows the rig to set up over each wellhead location. Typically, in new well operations, once the rig 22 is over the desired location, the rig will drill an "open hole" to a relatively shallow depth, and surface conductor will be installed and cemented into the open hole. Once the surface conductor is in place, a wellhead is attached to the surface conductor, and blowout preventer equipment attached to the wellhead.

Because of the risks of injury and pollution associated with the uncontrolled release of hydrocarbons, the wellheads and associated piping located in the wallaby 20 must be protected from items which may fall and damage the structural integrity of the wellheads or attached piping. The risk of falling equipment may be greater during operations associated with erecting or moving a modular drilling rig 22 or work over rig on the platform 10. When a rig 22 is initially erected on a platform 10, the usual practice is to lift the rig components off of a workboat with crane 16. Because various rig components are extremely heavy, if the components are dropped onto either a wellhead or associated piping, the structural integrity of those items may be compromised. For this reason, current MMS regulations require that the wells on the platform be closed in at the surface (i.e. at the platform level) as well as being shut-in at the subsurface safety valve during various activities, including erection of a rig and skidding of a rig.

On many platforms, the drill deck 12 adjacent to the well bay 20 comprises removable sections of relatively thin steel plate arranged in a grid pattern, where each section may be removed for accessing the wellhead 26 located below at the production deck 14. These sections are typically rated at 250 pounds per square foot. However, the removable sections are not typically of sufficient strength to prevent penetration by a heavy falling object, such as a falling drilling rig component. Therefore, these removable sections are generally not sufficient protection for the wellheads and related piping during rig erection or rig skidding operations.

The disclosed apparatus creates a steel shield over the wallaby 20 at approximately the level of the drill deck 12. This shield should provide an acceptable departure from the MMS requirement that a platform's wells be shut-in during rig erection or skidding operations. In addition, the method of installing the disclosed apparatus itself avoids heavy lifts over the wallaby 20, such that the wells need not be shut-in during the installation of the apparatus.

On most platforms there is usually open deck space on the drill deck 12 between the first line of wells in the wallaby 20 and the nearest edge of the platform, which is usually sixteen feet or greater. This area of open deck will henceforth be referred as the wing deck 24. The wing deck 24 is adjacent to the well bay 20, but does not directly overlie the wellheads 26 and associated piping. Therefore, materials may usually be deposited on the wing deck 24 by the crane 16 without shutting in any wells. Thus, the wing deck 24 is often used by the crane operator for setting down materials and supplies delivered to the platform by boat 18. The wing deck 24 may also be used for gathering and assembling the components of the disclosed wellhead protection apparatus.

As shown in FIG. 1 and explained in greater detail below, the platform crane 16 may be used to offload components of the apparatus from workboat 18 and set those components down on the wing deck 24. Once on the wing deck 24, an embodiment of the apparatus may be assembled and then—with the assistance of the crane, winch, or jacks—slid over the wellheads 26 located in the wallaby 20. Alternatively, as explained below, pre-assembled components of the apparatus may be delivered to the platform 10, placed on the wing deck 24, and likewise positioned over the wellheads 26.

The apparatus is constructed using existing platform skid beams 28, 30. The skid beams 28, 30 are generally disposed in parallel relation to one another as shown in FIG. 1. The skid beams 28, 30 may be several feet in height and the flanges on each side of the beams may have a width of over twenty inches. The top flange 29 of each skid beam 28, 30 generally extends above the drill deck 12. The skid beams are usually supported by the platform legs 33 as shown in FIG. 3*b*. On most fixed leg platforms, the skid beams 28, 30 are used for installing the components of a modular drilling rig 22. As discussed below, the top flange 29 of the skid beams 28, 30 generally has a plurality of longitudinal slots which may be utilized for moving and securing rig components to the skid beams.

Figure 3A:
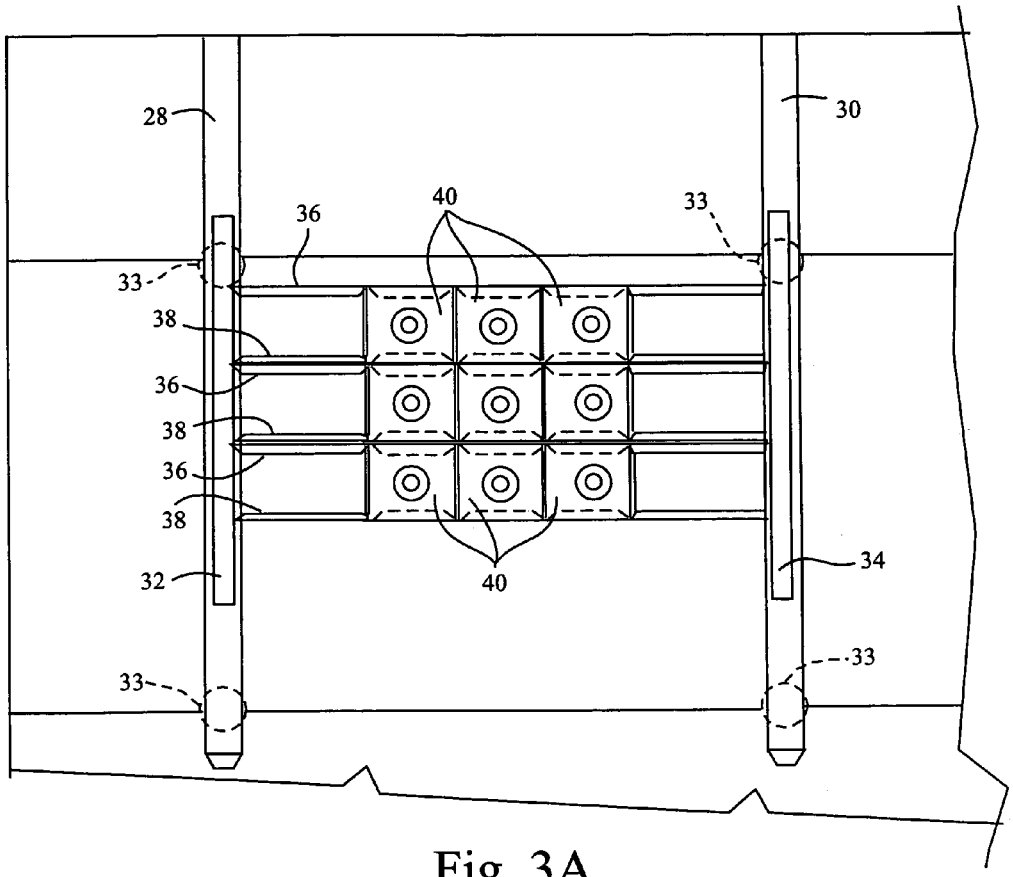
FIG. 3A shows a plan view of an embodiment of a wellhead cover assembly for positioning over a number of wellheads.
Figure 3B:
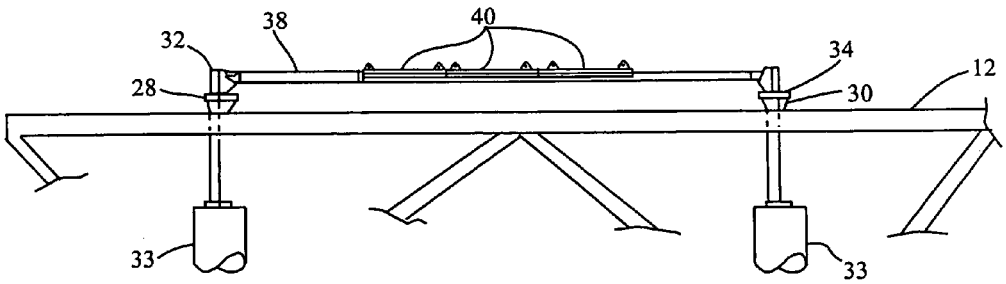
FIG. 3B shows an lavational view of the embodiment shown in FIG. 3A.
Figure 6A:
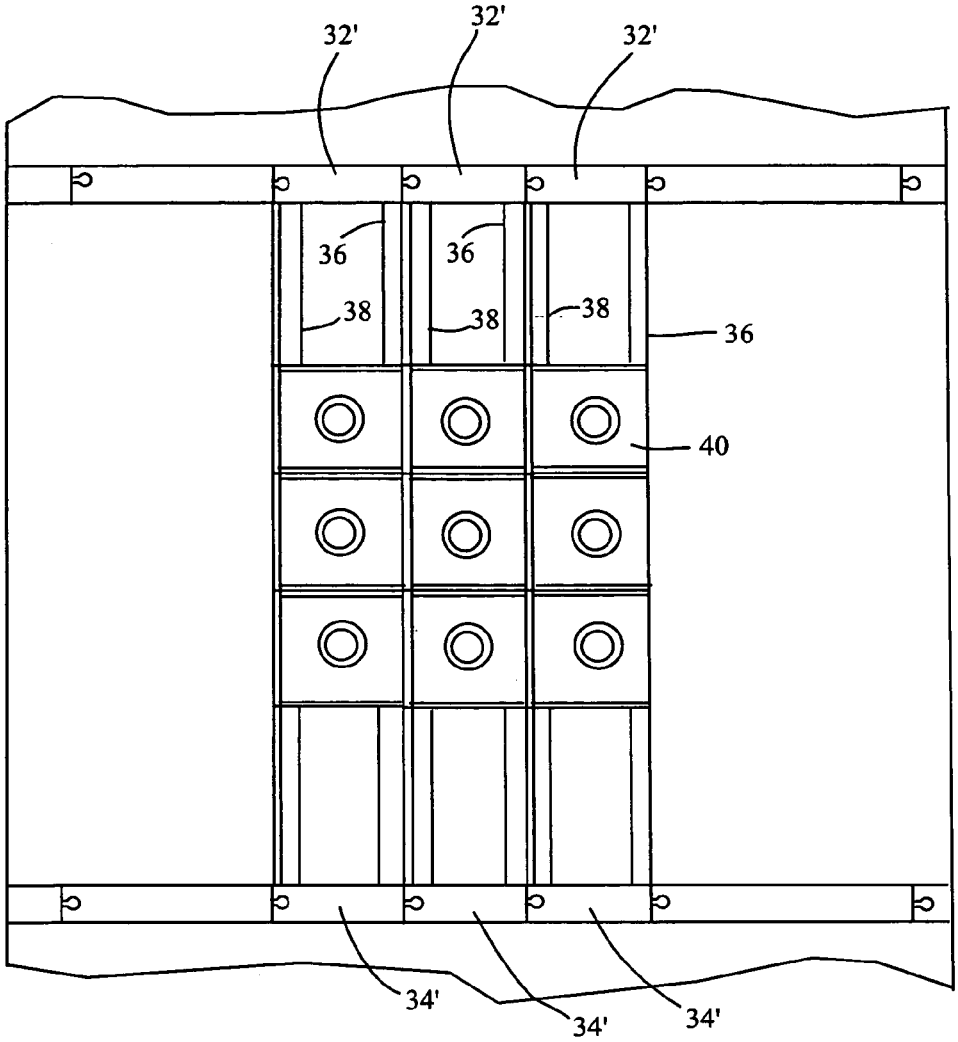
FIG. 6A shows a plan view of an embodiment of the disclosed apparatus.

One embodiment of the protection apparatus comprises a first support beam 32 which overlays at least a portion of the first skid beam 28 as generally depicted in FIG. 3A. Likewise, a second support beam 34 overlays at least a portion of the second skid beam 30. The support beams 32, 34 may either comprise single beam lengths as depicted in FIG. 3A, or may comprise a plurality of beam lengths assembled together as depicted in FIG. 6A.

The first support beam 32 and the second support beam 34 serve as foundational supports for the rig 22 instead of skid beams 28,30, so the first support beam and the second support beam each have top surfaces, including slots configured as those in the skid beams, such that the first support beam and the second support beam are adapted to receive modular components of either a drilling rig, work over rig, or other well maintenance equipment. The apparatus further comprises a first cross-member 36 and a second cross-member 38 spanning between the first support beam 32 and the second support beam 34, the first cross-member and second cross-member in general parallel relation to one another.

Figure 7A:
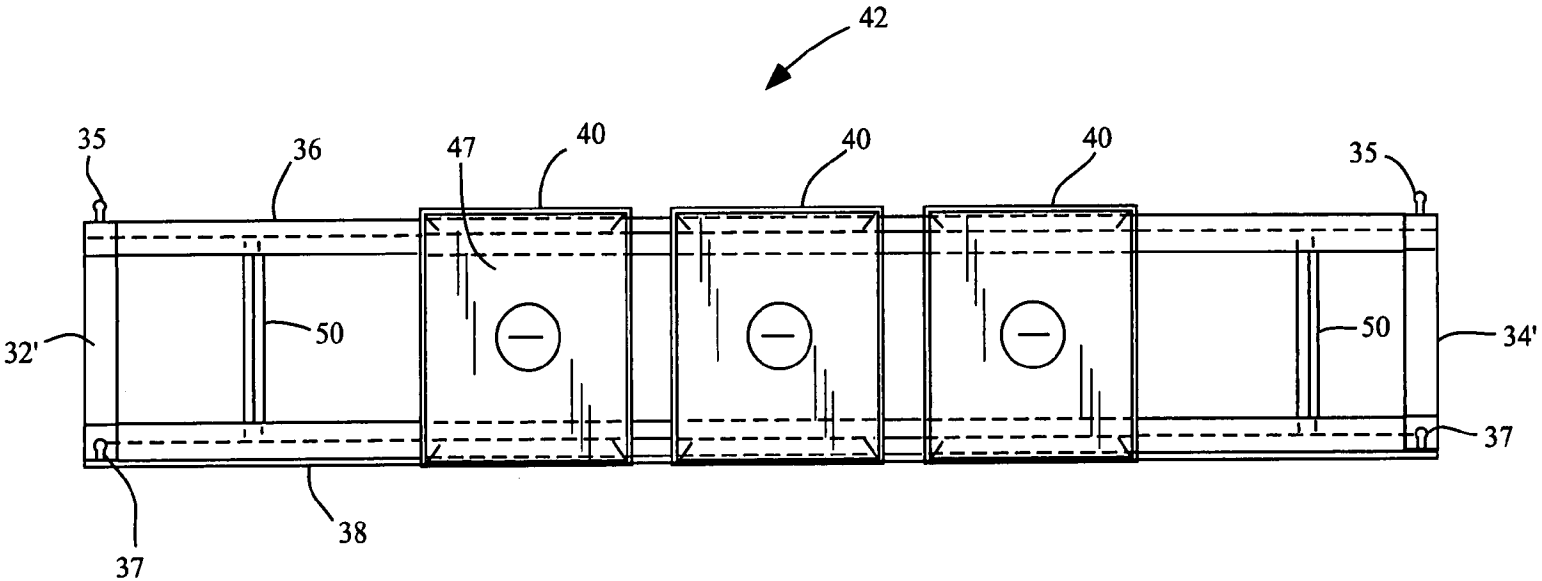
FIG. 7A shows a plan view of an embodiment of a wellhead cover assembly for protecting a row of three wellheads.
Figure 7B:
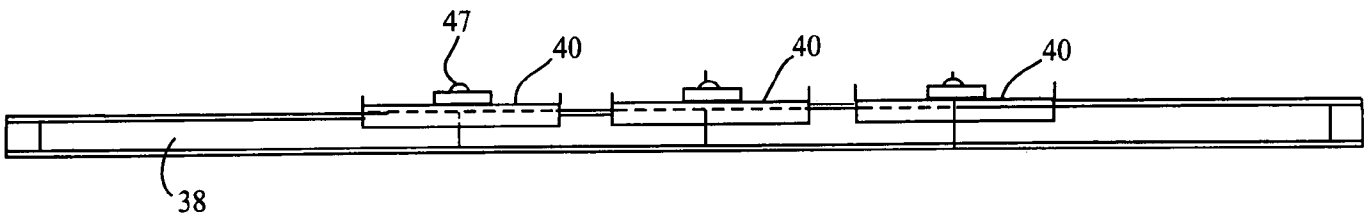
FIG. 7B shows an lavational view of the embodiment of FIG. 7A

At least one well cover panel 40 spans between the first cross-member 36 and the second cross-member 38. The well cover panel 40 may be configured to slid ably overlay the first cross-member 36 and the second cross-member 38, as shown in FIG. 7A. Utilizing the crane 16, jacks, winch, or other known mechanical means, well cover panel 40 may be slid or lifted along cross-members 36, 38 to expose and allow access to the wellhead located beneath the panel.

FIG. 7A also shows how the apparatus may be assembled on a sectional basis to form a wellhead cover assembly 42. The wellhead cover assembly comprises first support beam 32', second support beam 34', first cross-member 36, second cross-member 38, and one or more well cover panels 40. As further shown in FIG. 7A, the well cover panel may slid ably overlay the first cross-member 36 and to the second cross-member 38

Figure 4A:
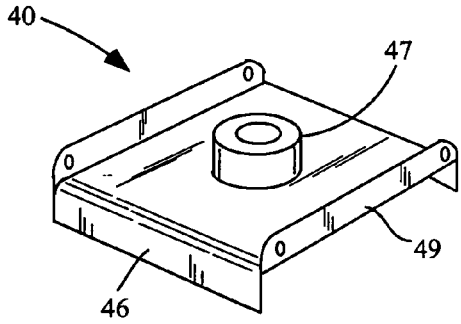
FIG. 4A shows an embodiment of individual well cover panel.
Figure 4B:
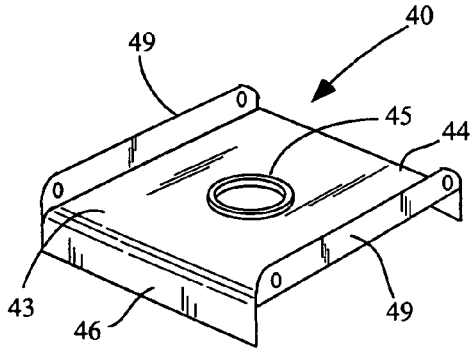
FIG. 4B shows another embodiment of an individual well cover panel.

As shown in FIGS. 4A and 4B, a well cover panel comprises a first side 43 and an opposing second side 44. The well cover panel 40 may further comprise opening 45 which would allow limited access to the wellhead beneath the panel. For example, wire line operations might be conducted through opening 45 without the need for removing the entire well cover panel 40. Well cover panel 40 may further comprise cover 47 adapted to fit over and close opening 45. The well cover panel may further comprise a first slide member 46 which overhangs the side of the first cross-member 36, as depicted in FIG. 5B.

Figure 5A:
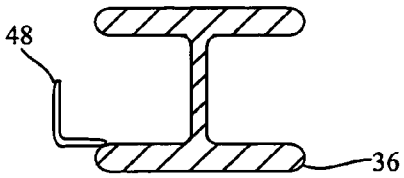
FIG. 5A shows an lavational view of an embodiment of a cross-member of the disclosed apparatus.
Figure 5B:
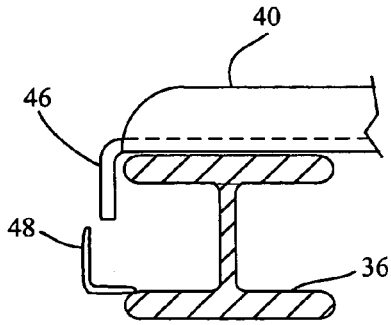
FIG. 5B shows a partial lavational view of a wellhead cover overlying the cross-member of FIG. 5A.

As shown in FIG. 5B, first cross-member 36 may comprise a drain 48 attached to the side of the first cross-member. First slide member 46 may be disposed inward of the drain as shown in FIG. 5B. The drain 48 may catch rain, seawater, rinse water, or effluent of drilling mud, oil, etc., diverting the liquids to a deck drain, separator, or other desired location. The well cover panel 40 may also comprise raised edge 49. The raised edge 49 would act to channel any liquids to drain 48. Cross-members 36, 38 may be disposed between the support beams 32, 34, such that the cross-members have a slightly higher elevation at the center of the span of the cross-members to improve drainage away from the center of the wallaby 20.

It is to be appreciated that an embodiment of the disclosed apparatus may be constructed using a variety of different steps. For example, if support beams 32, 34 are previously attached to the skid beams 28, 30, first cross-member 36 and the second cross-member 38 may be slid between the support beams from the wing deck 24 to a location overlying the wallaby 20. This step may be modified by previously attaching connecting members 50 between cross-members together so that the cross-members 36, 38 may be slid as a unit between the support beams 32, 34 with the cross-members maintained in parallel relation to one another. Upon being slid to the desired location, the ends of the first cross-member 36 and the second cross-member 38 are secured to the first support beam 32 and the second support beam 34. The ends may be fastened with conventional fastening means, such as welding or bolting.

Figure 8A:
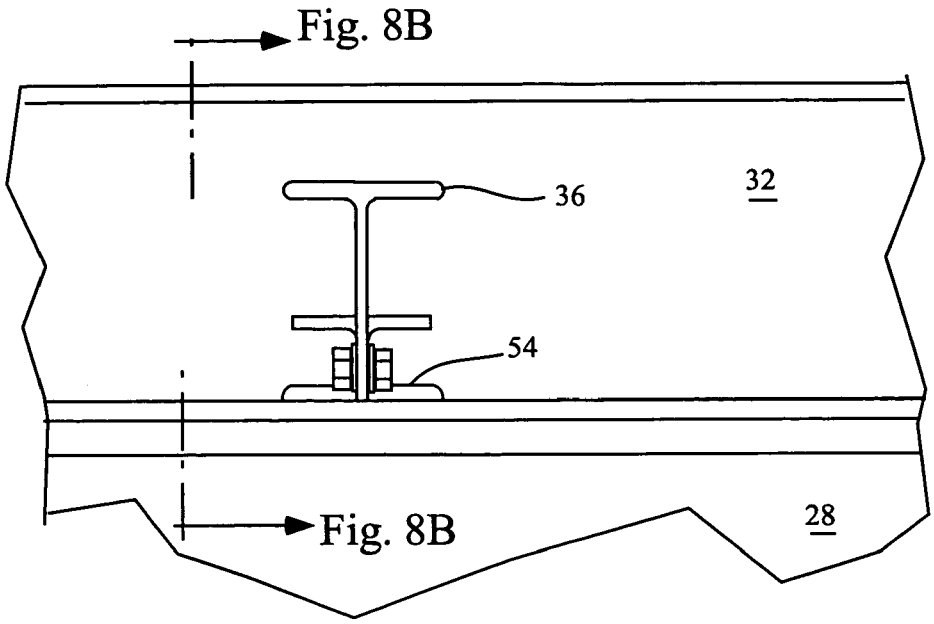
FIG. 8A shows one means of attaching a cross-member to a support member.
Figure 8B:
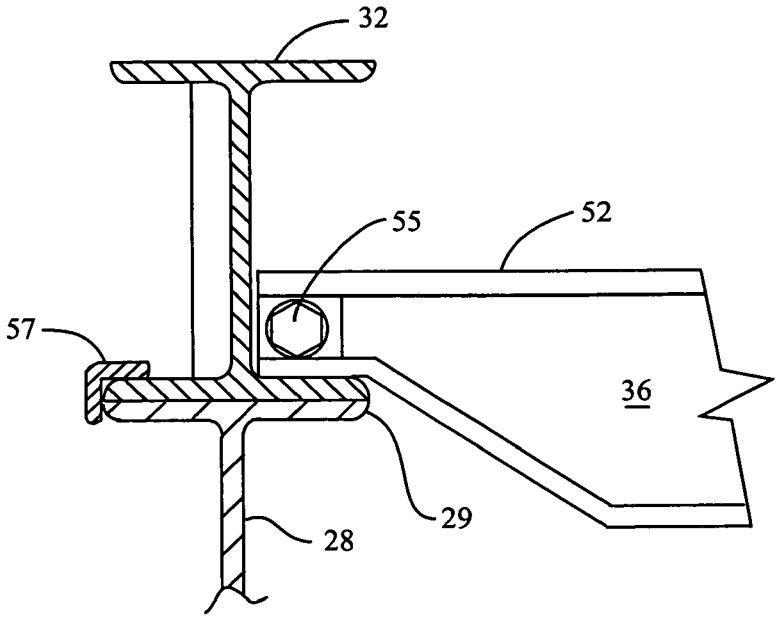
FIG. 8B shows a cross-section along line 8B-8B of FIG. 8A.

FIGS. 8A, 8B, 9A and 9B show different means for attaching the ends of the cross-members 36, 38 to support beams 32, 34. For example, as an alternative to welding the ends of the cross-members 36, 38 to support beams 32, 34, the ends 52 of a cross-member may be adapted, as shown in FIG. 8B, to abut the support beam and fastened to a fastener flange 54 with fastener 55. Fastener flange 54 is attached to the support beam 32, 34. The ends 52 of the cross-member 36, 38 may be tapered as shown in FIG. 8B. As shown in FIG. 5B, support beams 32, 34 may have guide 57 attached to the side of each beam to assist in aligning the support beams with the respective skid beams 28, 30 upon which the support beams will lay.

Figure 9B:
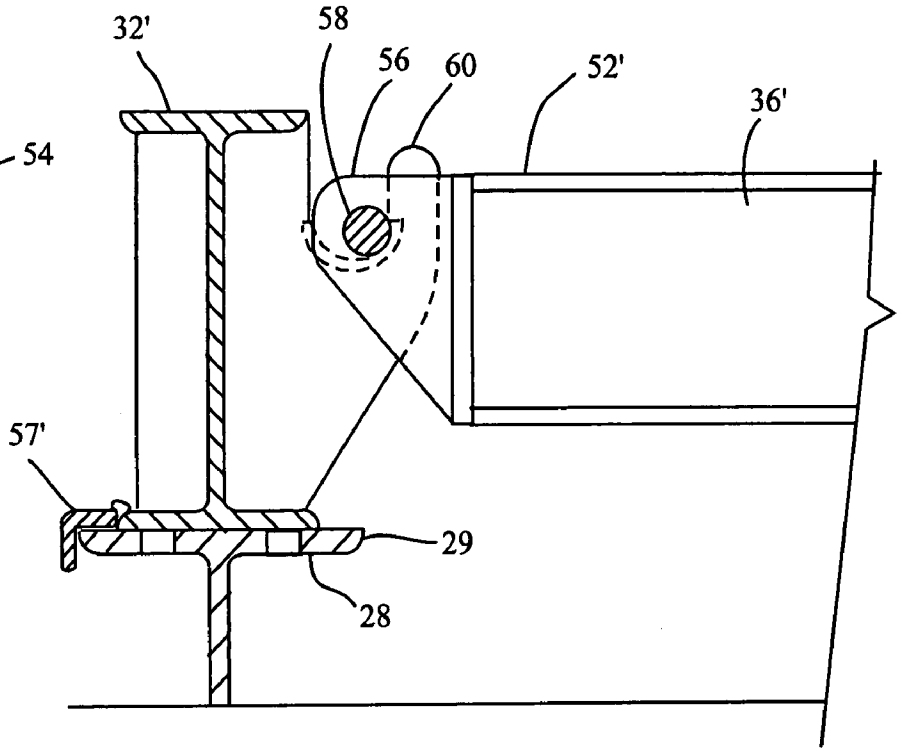
FIG. 9B shows a cross-section along line 9B-9B of FIG. 9A.
Figure 9A:
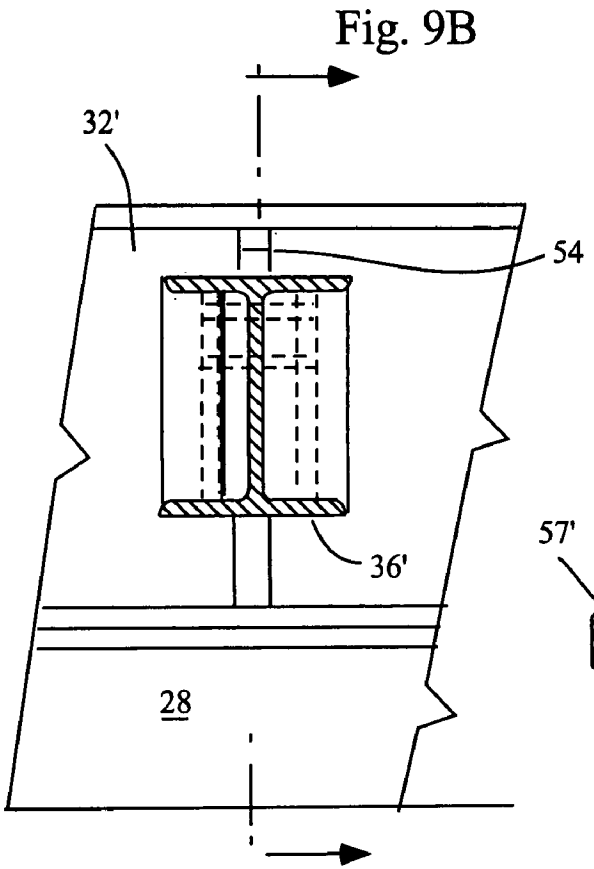
FIG. 9A shows another means of attaching a cross-member to a support member.
Figure 9C:
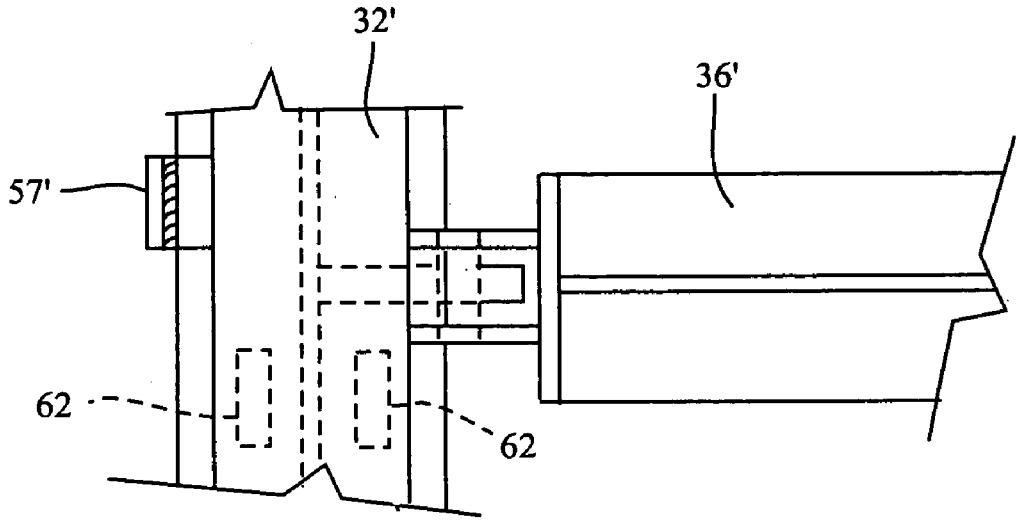
FIG. 9C shows a top view of FIG. 9B.

Alternatively, as shown in FIG. 9B, the ends 52' of a cross-member 36', 38' may comprise a tapered end 56 which either has pin 58 attached to or set through the tapered end. Pin 58 is set within receiving flange 60 attached to support beam 32', which may be formed in an upwardly facing "U" as shown in FIG. 9B for ease of connecting cross-member 36', 38' to support beam 32'. Of course, the materials and diameter of pin 58 should be selected as required to support the distributed weight of the apparatus and the impact loads which the apparatus might be expected to receive. Pin 58 may either be welded to tapered end 56, or inserted in or through an opening in tapered end 56.

It is to be appreciated that the embodiment shown in FIG. 9B, as compared to the embodiment shown in FIG. 8B, will raise the bottom of the support beams 32', 34' higher off of the drill deck 12, which allows the support beams to bend more before impacting the drill deck. For example only, a W14×109 beam impacted by a 15,000 pound load dropped from a height of twenty-four inches may cause the beam to be deflected approximately seven to eight inches at the center of the beam.

Support beams 32, 34 are to be sized according to the loading requirements of rig 22, and would typically be a W24×104 beam. Cross-members 36, 38 would typically be W14×109 beams. The well panels 40 should be of sufficient strength to resist a 20,000 load over an area of 100 $ft^2$ if dropped from a height of 2 feet above the panel. Therefore, the weight of the components of the apparatus will require that each component is set into place with mechanical assistance in the form of either the platform crane 16, leapfrog crane 17, the use of hydraulic or mechanical jacks, winches or other such devices known in the art.

The choice of fastening means for attaching support beams 32, 34 to the skid beams 28, 30 and for attaching the cross-members 36, 38 to the support beams 32, 34 is dependent upon the particular platform design, with the object of eliminating or minimizing the lifting of heavy members and components over the wallaby 20. Support beams 32, 34 may be single length beams which are attached to skid beams 28, 30 before other components of the apparatus are installed. The support beams 32,34 may be attached to the skid beams 28, 30 by known means of connecting two I-beams flange to flange, including welding, threaded fasteners or other known means.

Figure 6B:
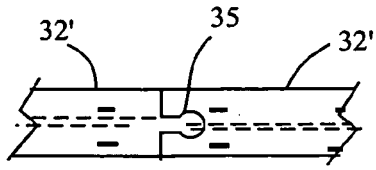
FIG. 6B shows a detailed view of how the support beams of the apparatus shown in FIG. 6A may be connected together.

Alternatively, the cross-members 36, 38 may be attached to a plurality of support beams 32', 34' which are attached to one another end-to-end as indicated on FIGS. 6A, 6B, and 7A. In this embodiment, the support beams 32', 34' are in short sections, such as three to four feet. As shown in FIG. 7A, the ends of each support beam 32' 34' may be configured to have a male end 35 or a female end 37, where the female end has a narrowed opening preventing the withdrawal of a larger portion of the male connector. As shown in FIG. 6A, these connectors allow the support beams to be locked together on an end-to-end basis by lowering the male end 35 into the female end 37, or lowering the female end over the male end. This feature allows a plurality of assembled wellhead cover assemblies 42 to be individually placed into position on skid beams 28, 30, but once placed into position, the wellhead cover assemblies may be locked together as shown in FIG. 6A. The support beams 32', 34' may also be attached end-to-end by other known fastening means such as threaded fasteners and welding.

Because an assembled wellhead cover assembly 42 may be slid along the skid beams 28, 30 by either a crane (in combination with block and tackle), jacks, or other mechanical means, as opposed to lifting the wellhead cover assembly over the wallaby 20, the apparatus may be installed without making any crane lifts over the wallaby. The wellhead cover assemblies 42 may be assembled at a site remote from the platform and delivered by workboat 18 in an assembled configuration as indicated on FIG. 1. The completed assemblies may then removed from the work boat 18 by either the platform crane 16 or a leapfrog crane 17, and set upon wing deck 24 or other location at which the lift may be made without swinging a load over the wallaby 20. Depending upon the location of the wing deck(s) 24 of the platform and the reach of the platform crane 16, it may be necessary to utilize a leapfrog crane 17 to place the wellhead cover assembly 42 at the desired location. Alternatively, the wellhead cover assemblies 42 may be assembled entirely on the platform, such as on the wing deck 24, and placed in position as discussed above.

Figure 10:
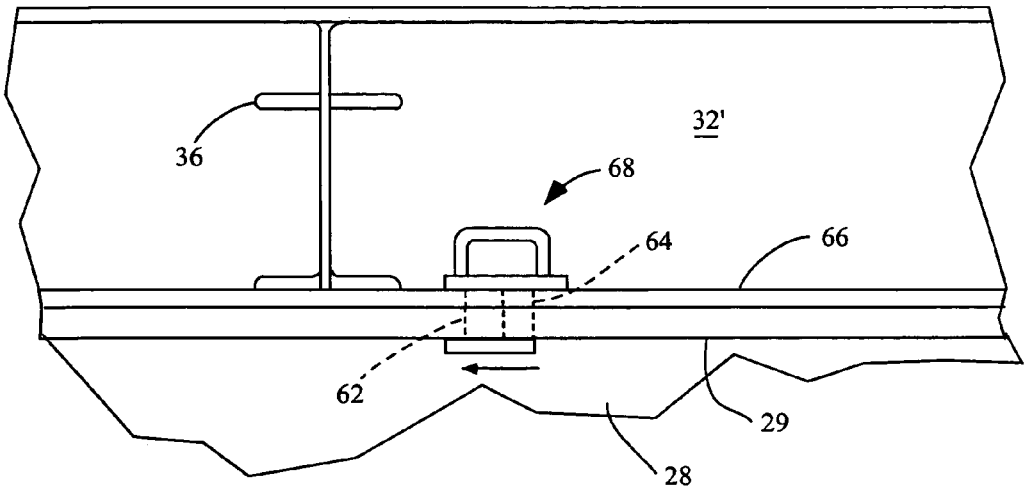
FIG. 10 shows a means of securing the support beams to the skid beams.
Figure 11A:
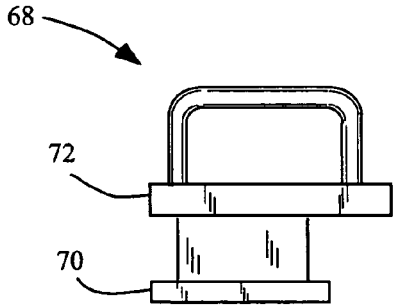
FIG. 11A shows a side view of the locking device shown in FIG. 10.
Figure 11B:
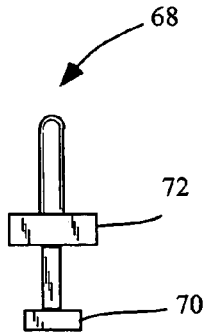
FIG. 11B shows a front view of the locking device shown in FIG. 10.

Once a wellhead cover assembly 42 is placed at the desired location along the skid beams 28, 30, the support beams 32', 34' are fastened to the skid beams. Conventional fastening means, such as welding and threaded fasteners may be used for this purpose. Alternatively, a temporary locking device may be used, which facilitates attachment and detachment of the support beams 32', 34' from the skid beams 28, 30. The skid beams 28, 30 usually have a series of slots 62 in the top flange 29. The slots 62 are generally used for attaching and skidding modular rig components to the skid beams 28, 30. The slots generally have dimensions of approximately two inches in width by six inches in length. As shown in FIG. 10, slots 62 may be used in conjunction with a generally corresponding and overlapping slot 64 in the bottom flange 66 of support beam 32'. Slide lock 68 may then be used to lock support beam 32' to skid beam 28 by inserting the bottom member 70 through both slot 62 and slot 64 and then sliding the lock such that bottom flange 66 and top flange 29 are sandwiched between the extended portion of bottom member 70 and the extended portion of top member 72 of the slide lock.

It is to be appreciated that because support beams 32, 34 (and 32', 34') will take the place of the skid beams 28, 30 for contact with the substructure of drilling rig 22, the support beams may also have a series of slots 62' in the top flange similar to the slots 62 in the skid beams to accommodate the installation and skidding of the rig components.

Figure 14:
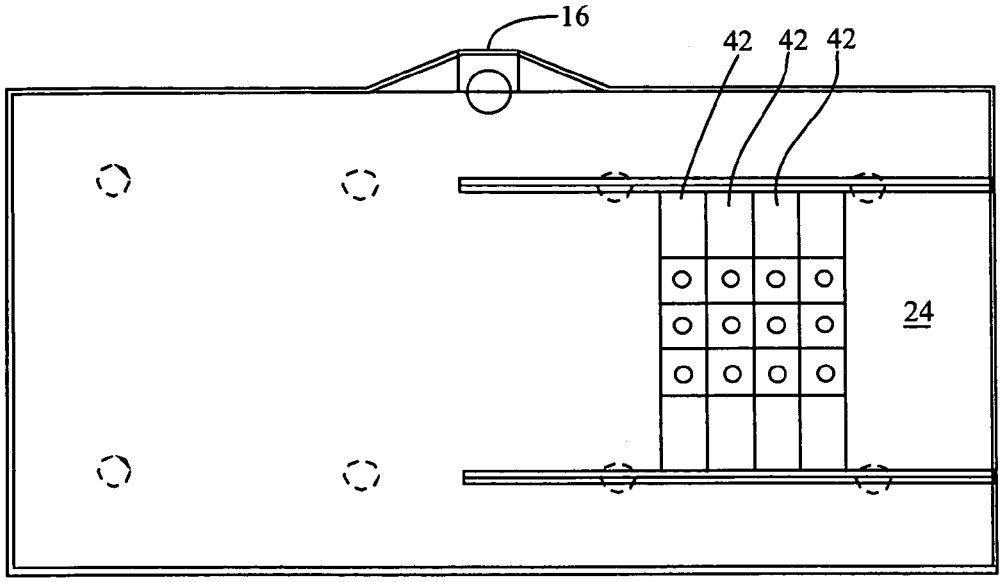
FIG. 14 shows a schematic of an embodiment of the disclosed apparatus after it has been slide into position over the well bay area.
Figure 15:
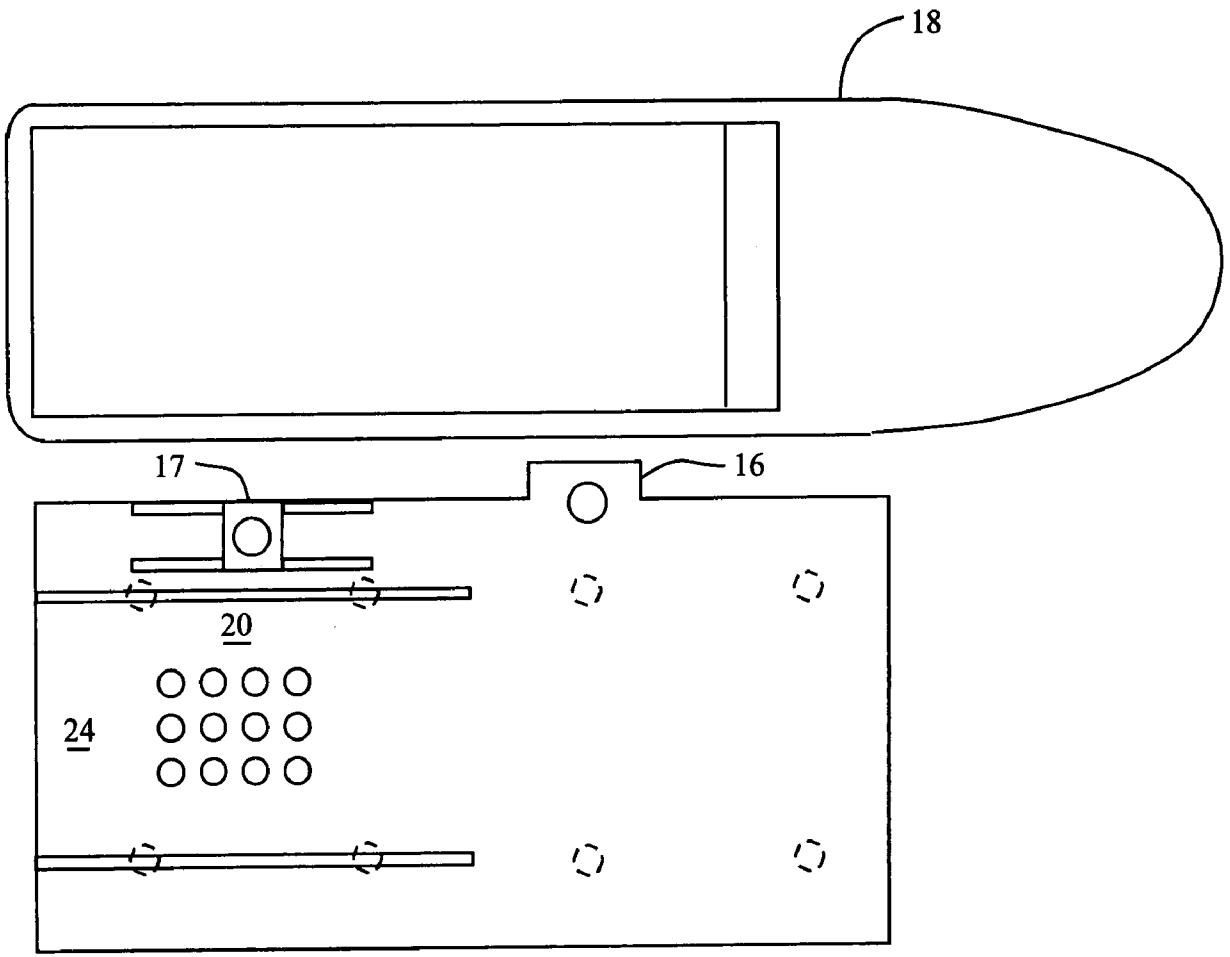
FIG. 15 shows how a leapfrog crane may be positioned in relation to the platform crane to assemble an embodiment of the apparatus.

FIGS. 12 through 14 generally show the sequence of how assembled wellhead cover assemblies may be placed on the wing deck 24 and then slide into place over the well bay 20. FIG. 15 shows how a leapfrog crane 17 may be positioned to lift materials of a workboat 18 in the event the platform crane 16 does not have sufficient reach to lift the materials off of the boat and place the materials at the wing deck 24.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. On an offshore drilling and production platform, the platform of the type having a wellhead disposed on a production deck through which wellhead hydrocarbon fluids are produced, the platform further comprising a first skid beam and a second skid beam, the skid beams generally disposed in parallel relation to one another and disposed above the production deck, an apparatus for protecting the wellhead during mobilization and operation of either well drilling or well maintenance equipment, the apparatus comprising:

a first support beam overlaying at least a portion of the first skid beam and a second support beam overlaying at least a portion of the second skid beam, the first support beam and the second support beam each having a top surface adapted for receiving either well drilling or well maintenance equipment;

a first cross-member and a second cross-member spanning between the first support beam and the second support beam, the cross-members in general parallel relation to one another;

means for securing the ends of the first cross-member and the second cross-member to the first support beam and the second support beam; and at least one well cover panel spanning between the first cross-member and the second cross-member, wherein the well cover panel comprises an opening having a removable cover, wherein access to the wellhead may be obtained by removing the removable cover.

2. The apparatus of claim 1 wherein the well cover panel slidably overlays a portion of the first cross-member and a portion of the second cross-member.

3. The apparatus of claim 1 wherein the well cover panel further comprises a first side end and an opposing second side.

4. The apparatus of claim 3 wherein the well cover panel comprises a first slide member attached to the first side.

5. The apparatus of claim 4 wherein the first slide member overhangs the side of the first cross-member.

6. The apparatus of claim 1 wherein the first cross-member comprises a drain on the side of the cross-member.

7. The apparatus of claim 6 wherein the well cover panel comprises a first slide member disposed inward of the drain.

8. The apparatus of claim 1 wherein the well cover panel comprises a raised edge.

9. The apparatus of claim 1 wherein the means for securing the end of the first cross-member to the first support beam comprises a fastener flange attached to the first support beam and fastener attaches the end of the first cross-member to the fastener flange.

10. The apparatus of claim 1 wherein the first cross-member comprises a tapered first end.

11. The apparatus of claim 10 wherein the means for securing the end of the first cross-member to the first support beam comprises the tapered first end comprising a pin and the first support beam comprises a receiving flange for receiving and retaining the pin.

12. The apparatus of claim 1 wherein the first skid beam comprises a first slot in the top flange of the beam, and the first support beam comprises a second slot in the bottom flange of the beam, and the first support beam is disposed on the first skid beam so that the first slot and the second slot are in general vertical alignment.

13. The apparatus of claim 12 wherein a sliding lock disposed within the first slot and the second slot attaches the first support beam to the first skid beam.

14. On an offshore drilling and production platform, the platform of the type having a wellhead disposed on a production deck through which wellhead hydrocarbon fluids are produced, the platform further comprising a first skid beam and a second skid beam, the skid beams generally disposed in parallel relation to one another and disposed above the production deck, an apparatus for protecting the wellhead during mobilization and operation of either well drilling or well maintenance equipment, the apparatus comprising:

a first support beam assembly overlaying at least a portion of the first skid beam and a second support beam assembly overlaying at least a portion of the second skid beam, wherein the first support beam assembly comprises a plurality of support beam members attached end to end, the first support beam assembly and the second support beam assembly each collectively having a top surface adapted for receiving either well drilling or well maintenance equipment;

a first cross-member and a second cross-member spanning between the first support beam assembly and the second support beam assembly, the first cross-member and second cross-member adapted to slide between the support beam assemblies in parallel relation to one another;

means for securing the ends of the first cross-member and the second cross-member to the first support beam assembly and the second support beam assembly; and at least one well cover panel spanning between the first cross-member and the second cross-member, the well cover panel comprising a first side end and an opposing second side end, the well cover panel slidably overlaying a portion of the first cross-member assembly and slidably overlaying a portion of the second cross-member assembly.

15. The apparatus of claim 14 wherein the means for connecting the plurality of first support beams end-to-end to one another comprises a male end being received by a female end.

16. The apparatus of claim 15 wherein the female end has a narrowed opening preventing the withdrawal of the male end.

17. A method for installing an apparatus for protecting a wellhead during mobilization and operation of either well drilling or well maintenance equipment on an offshore drilling and production platform, the platform of the type having the wellhead disposed on a production deck through which wellhead hydrocarbon fluids are produced, the platform further comprising a drilling deck disposed above the production deck, the drilling deck comprising a well bay area and an adjacent wing deck area, the well bay area overlaying the wellhead, the platform further comprising a first skid beam and a second skid beam, the skid beams generally disposed in parallel relation to one another and disposed above the production deck, the method comprising the following steps:

disposing a first support beam to overlay at least a portion of the first skid beam, wherein a first portion of the first support beam overlies the wing deck area and a second portion of the first support beam overlies the well bay area;

disposing a second support beam in parallel relation to the first support beam, wherein a first portion of the second support beam overlies the wing deck area and a second portion of the second support beam overlies the well bay area;

placing a first cross-member to span between the first portion of the first support beam and the first portion of the second support beam assembly;

placing a second cross-member to span between the first portion of the first support beam and the first portion of the second support beam, such that the first cross-member and second cross-member are adapted to slide in parallel relation to one another from a first position overlaying the wing deck to a second position overlaying the well bay;

disposing a well cover panel between the first cross-member and the second cross-member, the well cover panel adapted to slide across the lengths of the first cross-member and to the second cross-member, the well cover panel, the first cross-member, the second cross-member, and the well cover panel collectively comprising a wellhead cover assembly;

sliding the wellhead cover assembly from the first position to the second position; and sliding the well cover panel to a position directly overlying the wellhead.

* * * * *